US010639673B2

(12) United States Patent
Lee et al.

(10) Patent No.: US 10,639,673 B2
(45) Date of Patent: May 5, 2020

(54) LINEAR VIBRATOR

(71) Applicant: SHUNSIN TECHNOLOGY (ZHONG SHAN) LIMITED, Zhongshan (CN)

(72) Inventors: Shun-Long Lee, New Taipei (TW); Hong-Guang Huang, Shenzhen (CN)

(73) Assignee: SHUNSIN TECHNOLOGY (ZHONG SHAN) LIMITED, Zhongshan (CN)

( * ) Notice: Subject to any disclaimer, the term of this patent is extended or adjusted under 35 U.S.C. 154(b) by 55 days.

(21) Appl. No.: 15/868,033

(22) Filed: Jan. 11, 2018

(65) Prior Publication Data

US 2019/0015872 A1 Jan. 17, 2019

(30) Foreign Application Priority Data

Jul. 14, 2017 (CN) ..... 2017 1 0576652

(51) Int. Cl.
*B06B 1/04* (2006.01)
*B06B 1/02* (2006.01)

(52) U.S. Cl.
CPC ..... *B06B 1/045* (2013.01); *B06B 1/0246* (2013.01); *B06B 1/0261* (2013.01)

(58) Field of Classification Search
CPC ..... H02K 7/061; H02K 7/063; H02K 33/00; H02K 35/00; H02K 33/18; B06B 1/04; B06B 1/045; B06B 1/0245; B06B 1/0246; B06B 1/0253; B06B 1/0261
USPC ..... 310/19, 25, 12.16, 12.25, 15, 21, 29, 32, 310/36
See application file for complete search history.

(56) References Cited

U.S. PATENT DOCUMENTS 5,632,087 A * 5/1997 Motohashi ..... B26B 19/282 30/43.9
6,351,089 B1 * 2/2002 Ibuki ..... H02P 25/032 310/19
7,078,832 B2 * 7/2006 Inagaki ..... F04B 35/045 310/12.19
8,288,899 B2 * 10/2012 Park ..... H02K 33/16 310/25
2010/0327673 A1 * 12/2010 Jun ..... H02K 33/16 310/25

(Continued)

FOREIGN PATENT DOCUMENTS

CN 101944818 A 1/2011
CN 201918875 U 8/2011

(Continued)

*Primary Examiner* — Alfonso Perez Borroto
*Assistant Examiner* — Ahmed Elnakib
(74) *Attorney, Agent, or Firm* — ScienBiziP, P.C.

(57) ABSTRACT

A linear vibrator includes a shell, a first elastic member, a second elastic member, a weight, a magnet, and a coil. The shell has a receiving space, and first and second internal surfaces. The first elastic member and the second elastic member respectively contact the first internal surface and the second internal surface. The weight is mounted between the first elastic member and the second elastic member and has a receiving chamber. The magnet is mounted in the receiving chamber. The coil is located in the receiving chamber to cover the magnet and mounted on the shell. The linear vibrator is used for amplitude control and is compensated for by a printed circuit on the shell. The linear vibrator is small size, of simple structure, and has better performance.

7 Claims, 7 Drawing Sheets

(56) References Cited

U.S. PATENT DOCUMENTS

| | | | | |
|---|---|---|---|---|
| 2011/0018367 | A1* | 1/2011 | Kim | B06B 1/045 310/25 |
| 2012/0227269 | A1* | 9/2012 | Subramanian | B26B 19/282 30/210 |
| 2013/0169071 | A1* | 7/2013 | Endo | H02K 33/02 310/25 |
| 2013/0313919 | A1* | 11/2013 | Nakamura | H02K 33/00 310/25 |
| 2014/0035397 | A1* | 2/2014 | Endo | H02K 33/18 310/30 |
| 2014/0054983 | A1 | 2/2014 | Moon et al. | |
| 2014/0062224 | A1* | 3/2014 | Kim | H02K 33/16 310/15 |
| 2014/0265650 | A1* | 9/2014 | Jeon | H02K 33/16 310/25 |
| 2015/0137627 | A1* | 5/2015 | Katada | H02K 33/16 310/25 |
| 2015/0349619 | A1* | 12/2015 | Degner | H02K 41/0356 310/12.21 |
| 2016/0105089 | A1* | 4/2016 | Shi | H02K 33/18 310/25 |
| 2017/0070131 | A1* | 3/2017 | Degner | H02K 35/00 |
| 2017/0214307 | A1* | 7/2017 | Katada | B06B 1/045 |
| 2018/0278134 | A1* | 9/2018 | Hunstable | H02K 16/02 |

FOREIGN PATENT DOCUMENTS

| | | | |
|---|---|---|---|
| CN | 105281533 | A | 1/2016 |
| CN | 204947875 | U | 1/2016 |
| CN | 205622462 | U | 10/2016 |
| CN | 205960928 | U | 2/2017 |

* cited by examiner

LINEAR VIBRATOR

FIELD

The subject matter herein generally relates to a vibrator, and more particularly to a linear vibrator.

BACKGROUND

A vibrator is used as a non-audible input signal generator installed in a portable electronic product (such as a mobile phone, a game machine or other portable terminals). With the portable electronic product miniaturization and intelligence, smaller size and better performance of the vibrator for the portable electronic product is required.

Conventional linear vibrators are typically made of two types. One type of linear vibrator includes two magnets and a yoke, the two magnets are spliced on the yoke and completely in contact with the weight. The two magnets and the weight have a reciprocating linear motion along an axial direction relative to a shell of the linear vibrator. The movement of the weight needs an axis to guide. The linear vibrator with the above structure is difficult to assemble and the axis can easily deform. Another type of linear vibrator has a coil surrounding the weight and a supporting structure. The weight has a protrusion to be attached to the supporting structure. The coil and the weight have a reciprocating linear motion along with the supporting structure. This linear vibrator has low reliability and is unstable.

These problems with the two types of linear vibrators affect the user experience. Improvement in the art is preferred.

BRIEF DESCRIPTION OF THE DRAWINGS

Implementations of the present disclosure will now be described with reference to the attached figures.

DETAILED DESCRIPTION

Figure 1:
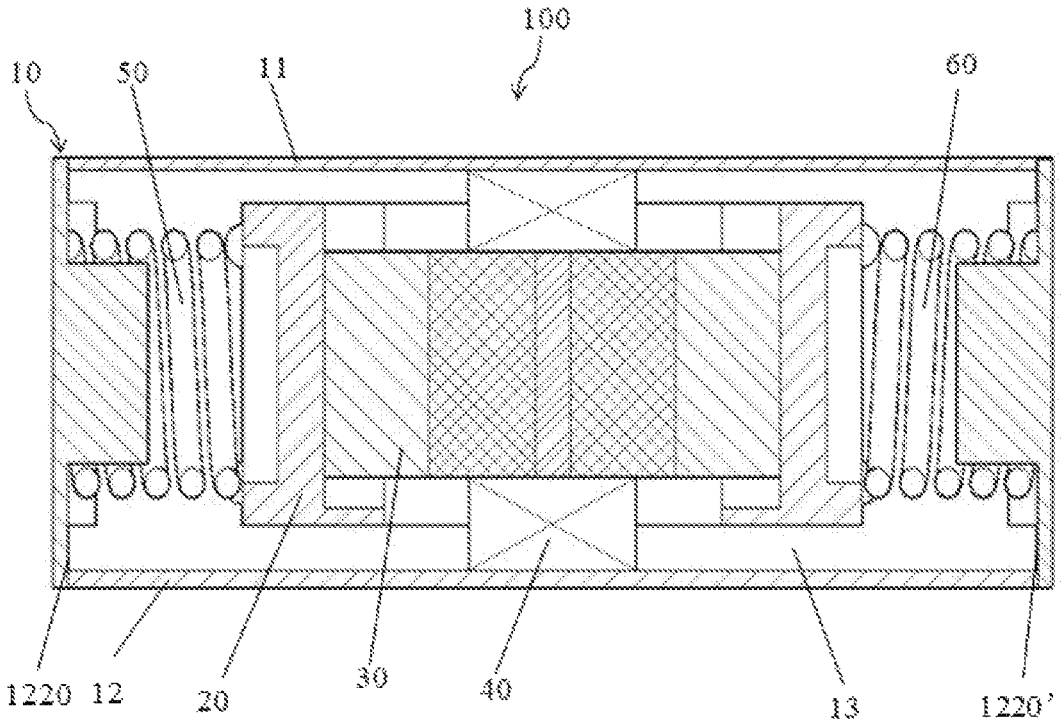
FIG. 1 is a cross-sectional view of an exemplary embodiment of a linear vibrator of the disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like reference numerals indicate the same or similar elements. It should be noted that references to "an" or "one" exemplary embodiment in this disclosure are not necessarily to the same exemplary embodiment, and such references can mean "at least one".

Referring to FIG. 1, an exemplary embodiment of a linear vibrator 100 includes a shell 10, a weight 20, a magnet 30, a coil 40, a first elastic member 50, and a second elastic member 60. The shell 10 includes a first cover 11 and a second cover 12. The first cover 11 is engaged with the second cover 12 and forms a receiving space 13. The weight 20, the magnet 30, the coil 40, the first elastic member 50, and the second elastic member 60 are received in the receiving space 13.

Figure 2:
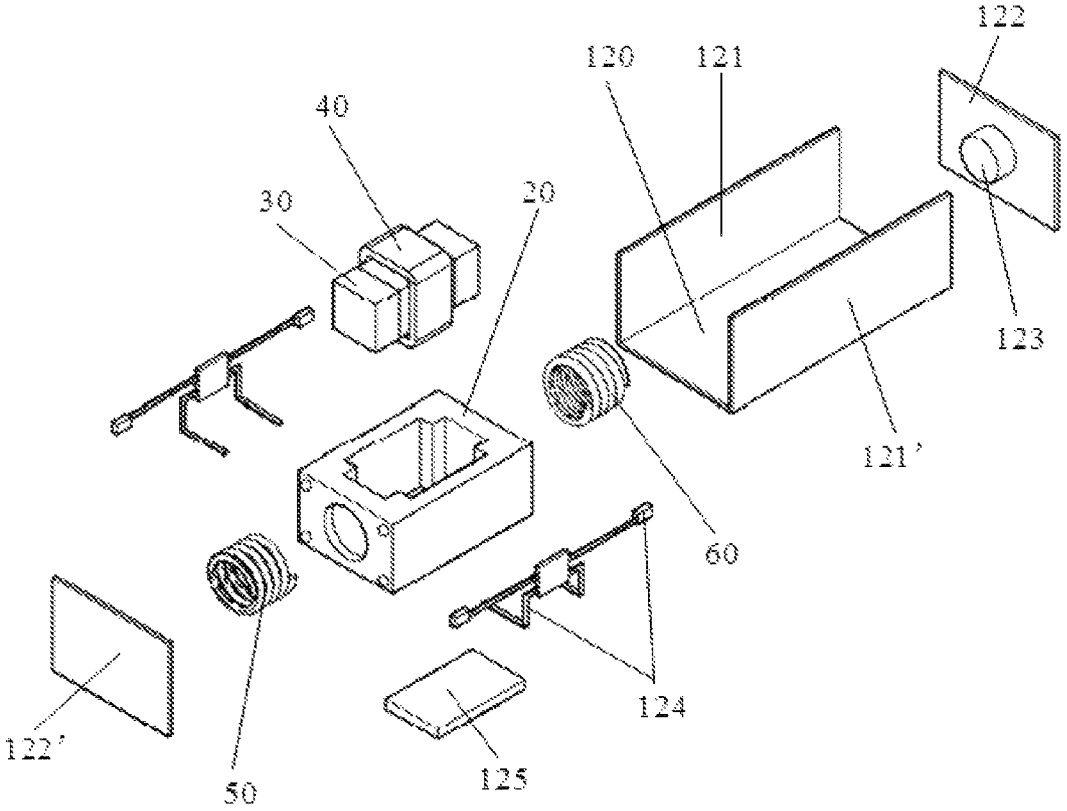
FIG. 2 is an exploded perspective view of the linear vibrator of FIG. 1 without a first cover.

Referring to FIG. 2, the second cover 12 includes a base plate 120, two first side plates 121 and 121' and two second side plates 122 and 122'. The two first side plates 121 and 121' vertically extend from the base plate 120. The two second side plates 122 and 122' are perpendicular to the base plate 120 and the two first side plates 121 and 121'. The two second side plates 122 and 122' are engaged with the base plate 120 and the two first side plates 121 and 121'. The two second side plates 122 and 122' each have a block 123. The base plate 120 and each of the two first side plates 121 and 121' are attached to each other with a printed circuit 124.

Figure 3:
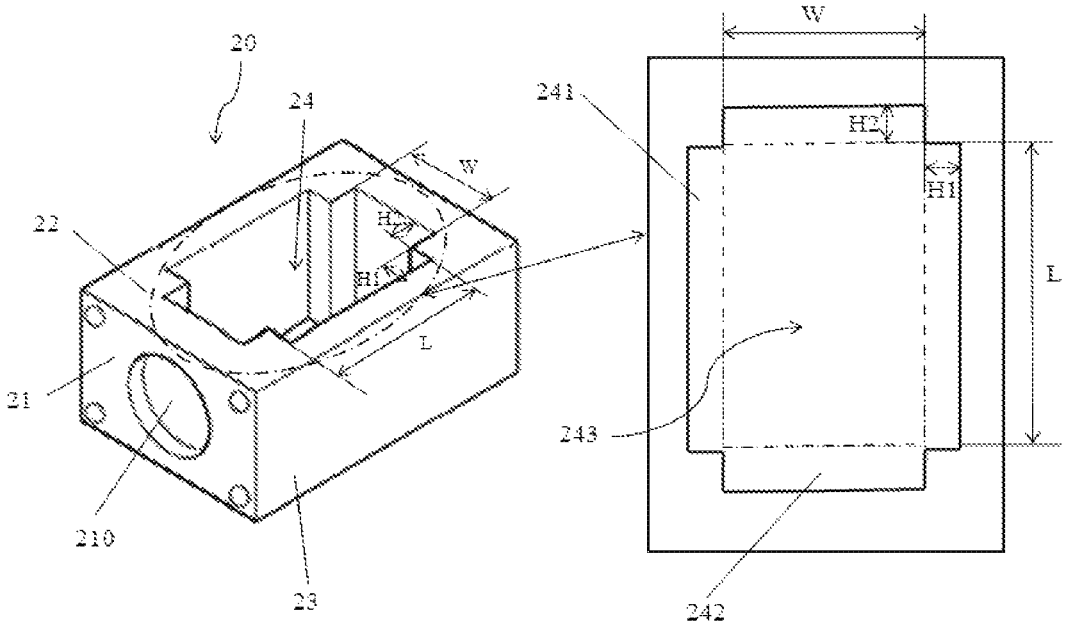
FIG. 3 is an isometric view of a weight in the vibrator of FIG. 1.

Referring to FIG. 3, the weight 20 is a rectangular solid with a cross-shaped cut-out. The weight 20 has a first surface 21 and a second surface 21' (shown in FIG. 6) opposite to the first surface 21, a third surface 22, and a fourth surface (not shown) opposite to the third surface 22. The weight 20 also has a fifth surface 23 and a sixth surface 23' (shown in FIG. 7) opposite to the fifth surface 23. The third surface 22 and the fourth surface are between the first surface 21 and the second surface 21'. The fifth surface 23 and the sixth surface 23' are between the first surface 21, the second surface 21', and also between the third surface 22 and the fourth surface. The first surface 21, the second surface 21', the third surface 22, the fourth surface, the fifth surface 23 and the sixth surface 23' define a receiving chamber 24. The receiving chamber 24 passes through the third surface 22 and the fourth surface. The first surface 21 and the second surface 21' each have a recess 210.

The receiving chamber 24 has two first grooves 241, two second grooves 242 and a first hole 243. The first hole 243 is in air communication with the two first grooves 241 and two second grooves 242. The two first grooves 241 each have a depth H1 and a length L. The two second grooves 242 each have a depth H2 and a width W.

Figure 4:
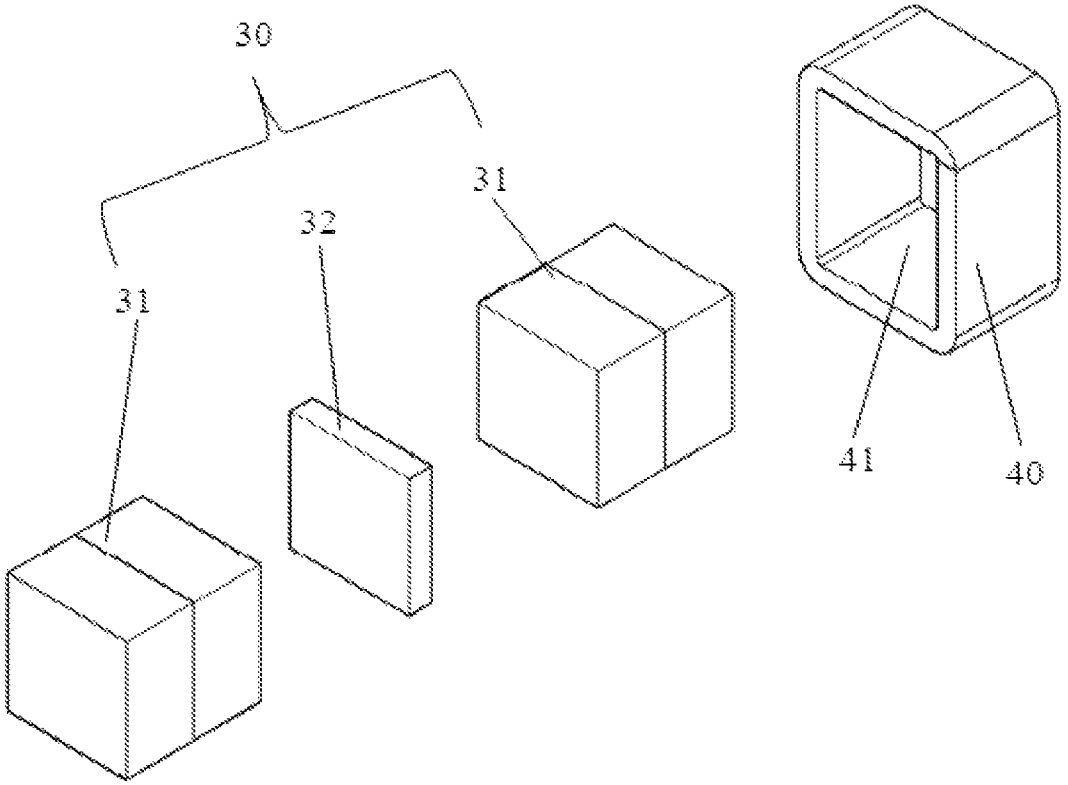
FIG. 4 is an exploded isometric view of a magnet and a coil in the vibrator of FIG. 1.

Referring to FIG. 4, the magnet 30 includes a plurality of magnetic bodies 31 and a yoke 32. The yoke 32 is bonded between two of the plurality of magnetic bodies 31. The magnetic bodies 31 bonded to the yoke 32 have the same magnetic poles adjacent to the yoke. In other words, an N polarity is formed in one side portion of each of the magnet bodies 31 adjacent to the yoke 32, and an S polarity is formed in the other side portions of the magnet bodies 31. Conversely, the S polarity is formed in one side portion of each of the magnet bodies 31 adjacent to the yoke 32, and the N polarity is formed in the other side portions of the magnet bodies 31. The coil 40 defines a second hole 41 to let the magnet 30 pass through.

Figure 5:
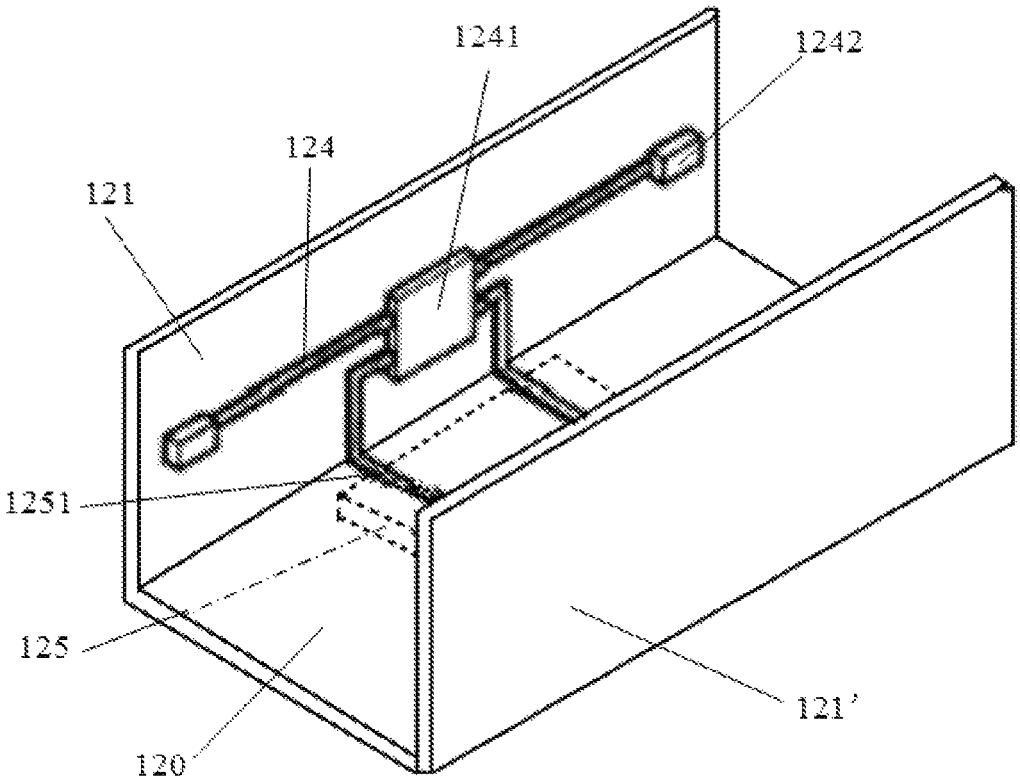
FIG. 5 is an isometric view of a portion of a shell in the vibrator of FIG. 1.
Figure 6:
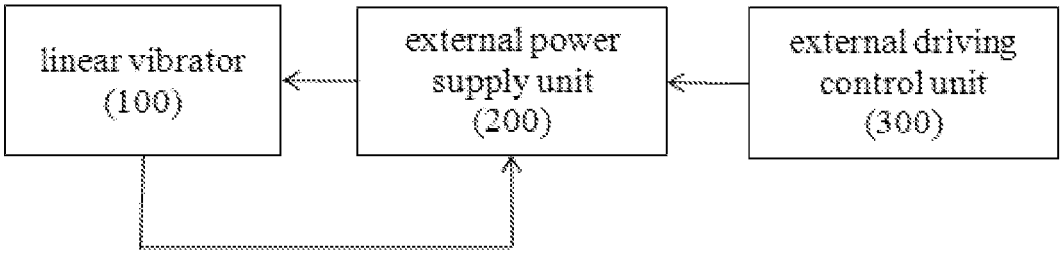
FIG. 6 illustrates a block diagram of the linear vibrator in FIG. 1 with an external power supply unit and an external driving control unit.

Referring to FIG. 5 and FIG. 6, a printed circuit 124 and a connector 125 are attached to the first side plates 121 and 121' and the base plate 120 of the second cover 12. The printed circuit 124 includes an electronic component 1241 and a sensor 1242 providing a trigger signal. The printed circuit 124 is electronically connected to the connector 125. The connector 125 has a signal port 1251 to connect to an external power supply unit 200 and an external driving control unit 300.

Figure 7:
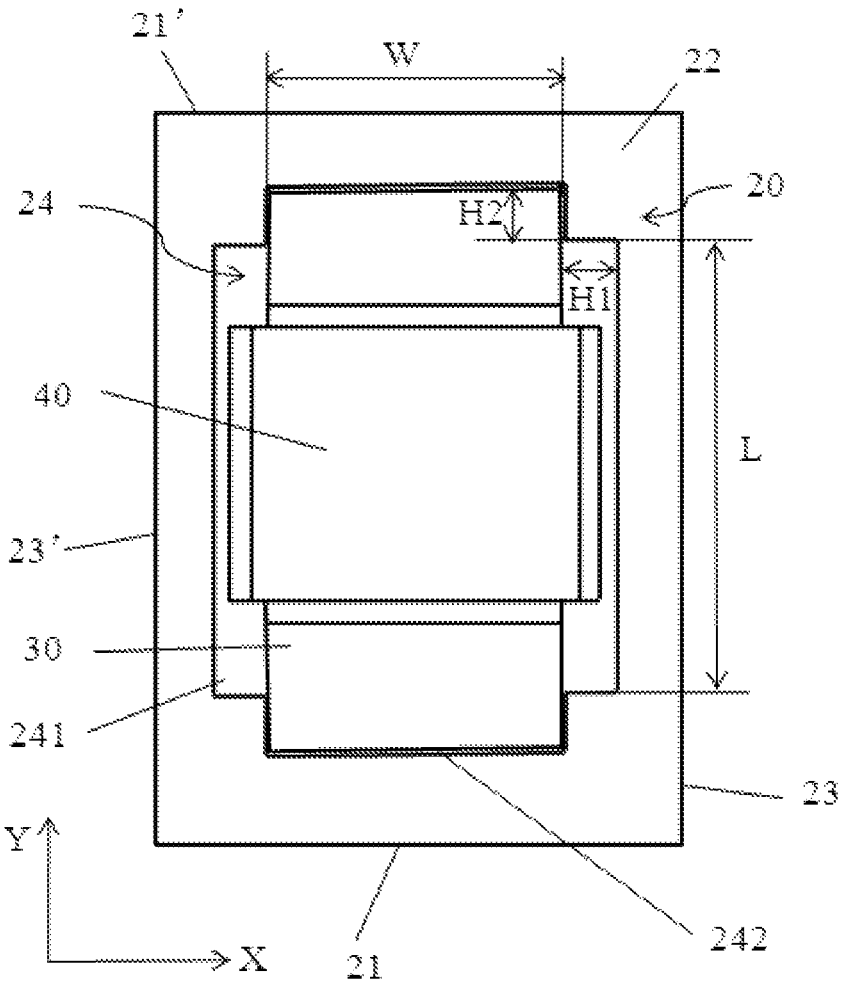
FIG. 7 is an elevation view of the weight, the magnet, and a matching coil of the vibrator of FIG. 1.

Referring to FIG. 7, the magnet 30 has a width W, the same as the width of the second groove 242. The magnet 30 has a length that is defined as L+2H2, and the magnet 30 is in contact with the weight 20. The magnet 30 is static relative to the weight 20. The coil 40 coils around the magnet 30. The coil 40 has a width smaller than a width W+2H1 in the direction of X axis. The coil 40 has a length much smaller than a length L so that the magnet 30 and weight 20 can move relative to the coil 40.

FIGS. 1-3 and 7 show the assembly process and working of the exemplary embodiment of the linear vibrator 100.

When assembled, the weight 20 is on the second cover 12 and mounted between the first elastic member 50 and the second elastic member 60. The shell 10 has a first internal surface 1220 and a second internal surface 1220' opposite to the first internal surface 1220. A first elastic member 50 contacts the first internal surface 1220, and a second elastic member 60 contacts the second internal surface 1220'. In the exemplary embodiment, the first elastic member 50 has one end installed on an internal surface 1220 of the second side plate 122. The second elastic member 60 has one end installed on an internal surface 1220' of another second side plate 122' opposite to the second side plate 122. The first elastic member 50 has the other end contacting the first surface 21 of the weight 20. The other end of the second elastic member 60 contacts the second surface 21' of the weight 20.

The two second side plates 122, 122' are opposite to each other, each has a block 120 extended from the internal surface of each of the two second side plate 122 and 122'. The first surface 21 and the second surface 21' each has a recess 210. The first elastic member 50 and the second elastic member 60 each have one end received by the recess 210, and the block 123 is embedded into the other end of the first elastic member 50 and the second elastic member 60. In another exemplary embodiment, the recess can be on the shell, and the block can be on the weight. The recess or the block can also be on the shell or the weight. Both the recess and the block support the first elastic member and the second elastic member. Stable movement of the weight 20 is improved because of the first elastic member 50 and the second elastic member 60 installed with the block 123 and the recess 210 and being supported by the block 123 and the recess 210.

The magnet 30 passes through the second hole 41 and is surrounded by the coil 40. The magnet 30 can move back and forth in the second hole 41. The magnet 30 and the coil 40 are together in the receiving chamber 24, and the magnet 30 is mounted between the first surface 21 and the second surface 21'. The width of the magnet 30 is equal to the width of the second groove 242, and the magnet 30 resists against the internal wall of the second groove 242. The magnet 30 is fastened on the receiving chamber 24, and the magnet 30 is static relative to the weight 20.

The coil 40 is positioned in the receiving chamber 4. There is a gap between the coil 40 and the first groove 241. There is another gap between the coil 40 and the second groove 242. The coil 40 passes through the receiving chamber 24 and extends out from the third surface 22 and the fourth surface (not shown). The first cover 11 is fastened on the second cover 12, the coil 40 contacts the first cover 11 and the second cover 12, and the coil 40 is fastened on the shell 10. The weight 20, the magnet 30, the coil 40, the first elastic member 50, and the second elastic member 60 are received in the receiving space 13.

When the linear vibrator 100 is in operation, the coil 40 is mounted on the shell 10. The coil 40 is not fastened on the weight 20, and the magnet 30 is mounted on the weight 20. The weight 20 and the magnet 30 move relative to the coil 40, and the movement direction of the coil 40 is the same as force directions of the first elastic member 50 and the second elastic member 60.

When the linear vibrator 100 receives an alternating current, the alternating current generates a changing magnetic field. The weight 20 and the magnet 30 move relative to the coil 40, and the weight 20 and the magnet 30 reciprocate with the changing magnetic field. The sensor 1242 triggers a signal of a certain amplitude after the coil 40 passes through the changing magnetic field. The signal feeds back to the external driving control unit 300 to adjust the signal output by the signal port 1251 on the connector 125. The amplitude is compensated for and controlled by the signal port 1251. The external power supply unit 200 and the external driving control unit 300 are arranged in a phone, a game machine, or other portable device.

In the exemplary embodiment, both of the coil and the magnet are in the weight. This facilitates simple assembly and decreases the overall volume taken up by the linear vibrator 100. The printed circuit 124 is on the shell 10 to electrical connect with the external supplying unit 200 and the external driving control 300 unit, for controlling and compensating for the amplitude when the linear vibrator 100 may become unstable.

The exemplary embodiments shown and described above are only examples. Many details are often found in the art such as the other features of linear vibrator. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the exemplary embodiments described above may be modified within the scope of the claims.

What is claimed is:

1. A linear vibrator comprising:

a shell having a first cover, a second cover, a receiving space, a first elastic member and a second elastic member;

the first cover is opposite to the second cover, the first cover and the second cover form the receiving space, the shell having a first internal surface and a second internal surface opposite to the first internal surface, the first elastic member being in contact with the first internal surface, and the second elastic member being in contact with the second internal surface;

a weight having a receiving chamber; the weight mounted between the first elastic member and the second elastic member, wherein the weight has a first surface and a second surface opposite to the first surface, the weight has a third surface and a fourth surface opposite to the third surface, and the first elastic member and the second elastic member are respectively in contact with the first surface and the second surface;

a magnet mounted on the receiving chamber; and a coil being in the receiving chamber to cover the magnet and mounted on the shell, wherein the coil passes through the receiving chamber and extends out from the third surface and the fourth surface, and the coil contacts the first cover and the second cover so as to fasten on the shell, wherein the weight is a rectangular solid with a cross-shaped cut-out, the receiving chamber has two first grooves, two second grooves and a first hole, the first hole is in air communication with the first grooves and the second grooves, two opposite sides of the coil are located in the first grooves, and two ends of the magnet are located in the second grooves, wherein a width of the magnet is the same as a width of the second grooves, a width of the coil is greater than the width of the second grooves, the third surface and the fourth surface are between the first surface and the second surface.

2. The linear vibrator of claim 1, wherein the receiving chamber passes through the third surface and the fourth surface.

3. The linear vibrator of claim 1, wherein the magnet is mounted between the first surface and the second surface.

4. The linear vibrator of claim 1, wherein the magnet is static relative to the weight, the magnet has a movement direction relative to the coil, the movement direction of the magnet is the same as force directions of the first elastic member and the second elastic member.

5. The linear vibrator of claim 1, wherein the first surface and the second surface each have a recess, the first internal surface and the second internal surface of the shell relative to the first surface and the second surface each have a block, the first elastic member and the second elastic member each have one end received by the recess, and the block of the first internal surface and the second internal surface is embedded into the other end of the first elastic member and the second elastic member.

6. The linear vibrator of claim 1, wherein the magnet comprises a plurality of magnetic bodies and a yoke, the yoke is between the plurality of magnetic bodies, the plurality of magnetic bodies adjacent to the yoke has the same magnetic poles.

7. The linear vibrator of claim 1, wherein the shell comprises a printed circuit and a connector, the printed circuit comprises an electronic component and a sensor, the connector has a signal port for connecting to an external power supply unit.

* * * * *